US008508423B2

(12) United States Patent
Suetsuna et al.

(10) Patent No.: US 8,508,423 B2
(45) Date of Patent: Aug. 13, 2013

(54) ANTENNA DEVICE

(75) Inventors: Tomohiro Suetsuna, Kanagawa (JP); Makoto Higaki, Kanagawa (JP); Kouichi Harada, Tokyo (JP); Seiichi Suenaga, Kanagawa (JP); Mitsuru Ishibashi, Kanagawa (JP); Maki Yonetsu, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1043 days.

(21) Appl. No.: 12/410,768

(22) Filed: Mar. 25, 2009

(65) Prior Publication Data

US 2009/0295662 A1 Dec. 3, 2009

(30) Foreign Application Priority Data

May 30, 2008 (JP) ..... 2008-141856

(51) Int. Cl.
*H01Q 1/00* (2006.01)
*H01Q 19/10* (2006.01)
*H01Q 1/38* (2006.01)

(52) U.S. Cl.
USPC ..... 343/787; 343/818; 343/700 MS

(58) Field of Classification Search
USPC ..... 343/818
See application file for complete search history.

(56) References Cited

U.S. PATENT DOCUMENTS 4,320,080 A * 3/1982 Esper et al. ..... 419/32
5,563,616 A * 10/1996 Dempsey et al. ..... 343/753
6,323,810 B1 * 11/2001 Poilasne et al. ..... 343/700 MS
7,285,329 B2 * 10/2007 Kaneko et al. ..... 428/403
2008/0150825 A1 6/2008 Higaki et al.
2008/0220231 A1 9/2008 Suetsuna et al.
2009/0040112 A1 2/2009 Sekine et al.

FOREIGN PATENT DOCUMENTS

JP 07-221536 8/1995
JP 2006-222873 8/2006
JP 2007-124696 5/2007

OTHER PUBLICATIONS

"Reflection and Transmission," Advanced Engineering Electromagnetics, Constantine Balanis, John Wiley and Sons, 1989, pp. 180 to 243.*
"Capacitors and Capacitance," John D Kraus, Electromagnetics, Second Edition, McGraw Hill, 1973.*
U.S. Appl. No. 12/623,749, filed Nov. 23, 2009, Inoue, et al.
U.S. Appl. No. 12/351,235, filed Jan. 9, 2009, Makoto Higaki, et al.

(Continued)

*Primary Examiner* — Jacob Y Choi
*Assistant Examiner* — Graham Smith
(74) *Attorney, Agent, or Firm* — Oblon, Spivak, McClelland, Maier & Neustadt, L.L.P.

(57) ABSTRACT

The present invention provides a small antenna device realizing both miniaturization including lower profile and a broader band in a frequency band of hundreds MHz to 5 GHz and which can be mounted on a small device such as a cellular phone. An antenna device includes: a finite ground plane; a rectangular conductor plate provided above the finite ground plane, whose one side is connected to the finite ground plane, and having a bent portion substantially parallel with the one side; an antenna disposed substantially parallel with the finite ground plane above the finite ground plane, extending in a direction substantially perpendicular to the one side, and having a feeding point positioned near the other side facing the one side of the rectangular conductor plate; and a magnetic material provided in at least a part of space between the finite ground plane and the antenna.

20 Claims, 7 Drawing Sheets

(56) References Cited

OTHER PUBLICATIONS

U.S. Appl. No. 12/188,522, filed Aug. 8, 2008, Kazuhiro Inoue, et al.
U.S. Appl. No. 12/184,735, filed Aug. 1, 2008, Makoto Higaki, et al.
U.S. Appl. No. 12/351,235, filed Jan. 9, 2009, Higaki, et al.
Office Action issued Nov. 20, 2012 in Japanese Application No. 2008-141856 filed May 30, 2008 (w/English translation).

* cited by examiner

14
J
A
B
10
12
B1
B2
A+B
B1+B2
PEC (φ=180°)
PMC (φ=0°)
φ=120°
φ=120°

ANTENNA DEVICE

CROSS-REFERENCE TO RELATED APPLICATION

This application is based upon and claims the benefit of priority from Japanese Patent Applications No. 2008-141856, filed on May 30, 2008, the entire contents of which are incorporated herein by reference.

FIELD OF THE INVENTION

The present invention relates to an antenna device for use in a communication system requiring a small, wide-band antenna device.

BACKGROUND OF THE INVENTION

In various communication systems, on the basis of a request for miniaturization and higher performance of a device, a small and broadband antenna is in demand. Examples of antennas addressing the request for miniaturization are an inverted-F antenna and a patch antenna. Even if the profile of the inverted-F antenna is lowered (miniaturized) by a metal pin which is short-circuited near a feeding point, antenna matching can be obtained. However, a problem occurs such that the frequency band in which matching is obtained is limited by a small loop passing through the feeding point and the metal pin. Consequently, the height of the antenna adapted to a plurality of broadband wireless systems is necessary.

A patch antenna is constructed by disposing a radiative conductor and a conductive bottom board so as to face each other with an insulating material as an inclusion therebetween. The patch antenna can be thinned and miniaturized. However, the patch antenna also has a problem that the operable band is narrow.

On the other hand, as disclosed in JP-A 2007-124696 (KOKAI), an attempt to broaden the operable band by inserting a magnetic material in the patch antenna is also made. However, the combination of the patch antenna and the magnetic material disclosed in the literature does not always sufficiently satisfy miniaturization and a broader band. The resonance frequency is relatively high like 3.5 to 4.5 GHz.

To make the effect of broadening the band by inserting a magnetic material to an antenna displayed, thickness of 10 μm or larger, preferably, 100 μm or larger is necessary. The dielectric property of the magnetic material exerts an influence on the antenna characteristics and has to have high insulating performance. However, at present, there is no insulating magnetic material having high magnetic permeability in a high frequency band of 3.5 to 4.5 GHz and having a thickness of 10 μm or larger, preferably, 100 μm or larger.

SUMMARY OF THE INVENTION

A conventional antenna device has a problem that it is difficult to satisfy both miniaturization including lower profile and a broader band in the frequency band of hundreds MHz to 5 GHz.

An antenna device as an embodiment of the present invention includes: a finite ground plane; a rectangular conductor plate provided above the finite ground plane, whose one side is connected to the finite ground plane, and having a bent portion substantially parallel with the one side; an antenna disposed substantially parallel with the finite ground plane above the finite ground plane, extending in a direction substantially perpendicular to the one side, and having a feeding point positioned near the other side facing the one side of the rectangular conductor plate; and a magnetic material provided in at least a part of space between the finite ground plane and the antenna.

An antenna device as another embodiment of the present invention includes: a finite ground plane; a magnetic material above the finite ground plane; a rectangular conductor plate above the magnetic material; a conductor passing through the magnetic material and connecting a part around one side of the rectangular conductor plate to the finite ground plane; and an antenna disposed substantially parallel with the finite ground plane above the finite ground plane, extending in a direction substantially perpendicular to the one side, and having a feeding point positioned near the other side facing the one side of the rectangular conductor plate.

An antenna device as further another embodiment of the present invention includes: a finite ground plane; a comb-shaped line conductor provided above the finite ground plane, whose one end is connected on a predetermined linear line of the finite ground plane, having a bent portion which is bent at substantially right angle and is substantially parallel to the linear line, and whose other end is substantially parallel to the linear line; an antenna disposed substantially parallel with the finite ground plane above the finite ground plane, extending in a direction substantially perpendicular to the linear line, and having a feeding point positioned near the other end of the comb-shaped line conductor; and a magnetic material provided in at least a part of space between the finite ground plane and the antenna.

The present invention can provide a small antenna device realizing both miniaturization including lower profile and a broader band in a frequency band of hundreds MHz to 5 GHz and which can be mounted on a small device such as a cellular phone.

DETAILED DESCRIPTION OF THE EMBODIMENTS

Figure 1A:
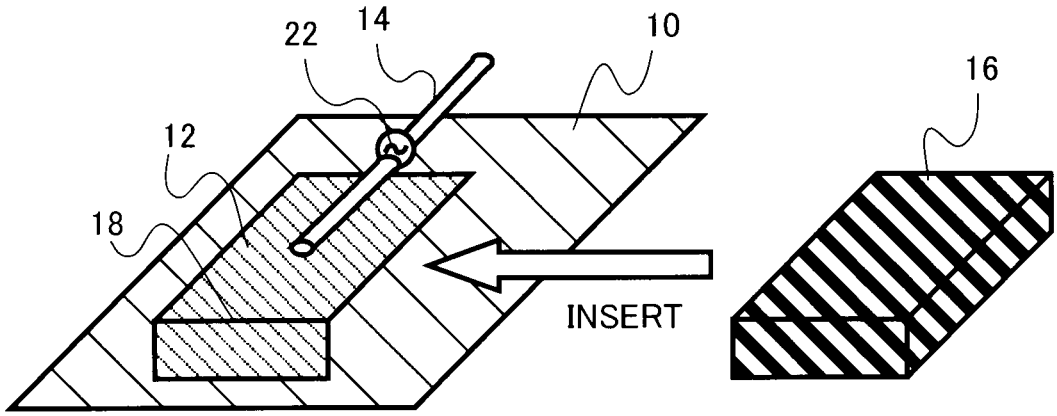
FIGS. 1A to 1C are configuration diagrams of an antenna device of a first embodiment.

As described above, in a conventional antenna device, it is difficult to realize both miniaturization including lower profile and wider bandwidth in the bandwidth of hundreds MHz to 5 GHz. To solve the problem, the inventors of the present invention have devised and attempted combination of a novel antenna structure and a novel insulating high-permeability thick magnetic material having an excellent magnetic characteristic (high μ' and low μ") (having a thickness of 10 μm or more, preferably, 100 μm or more).

As a thick magnetic material having a thickness of 10 μm or more, preferably, 100 μm or more realizing relatively high permeability in the band of hundreds MHz to 5 GHz, hexagonal ferrite may be considered. However, in a high frequency band of hundreds MHz, the permeability becomes close to the ferromagnetic resonance frequency, therefore, it may not be used because the magnetic loss becomes significant by resonance.

On the other hand, a magnetic material is being actively developed with the thin film techniques such as sputtering and plating. It is confirmed that an excellent characteristic is displayed in the high frequency band at a thin film level. However, a characteristic when the thickness of the film is 10 μm or more is not confirmed. There is a problem that it takes very long time to obtain a thick film of 10 μm or, preferably, 100 μm or more. Since the electrical resistance of a thin-film magnetic material is generally low, induced current is generated, and a problem occurs such that an adverse influence is exerted on the antenna characteristic.

Further, large equipment is necessary for the thin film technique such as sputtering. In addition, the controllability on film thickness and the like is not always excellent. Therefore, the method is not always sufficiently satisfactory from the viewpoints of cost and yield. As will be described below, the inventors of the present invention have developed an insulating high-permeability thick-film magnetic material having excellent high-frequency magnetic characteristics, that is, having a high permeability real part (μ') and a low permeability imaginary part (μ") in a high frequency band and realizing extremely suppressed transmission loss, and apply it to an antenna device.

Embodiments of the present invention will be described hereinbelow with reference to the drawings.

First Embodiment

An antenna device of the embodiment has: a finite ground plane; a rectangular conductor plate provided above the finite ground plane, whose one side is connected to the finite ground plane, and having a bent portion substantially parallel with the one side; an antenna disposed substantially parallel with the finite ground plane above the finite ground plane, extending in a direction substantially perpendicular to the one side, and having a feeding point positioned near the other side facing the one side of the rectangular conductor plate; and a magnetic material provided in at least a part of space between the finite ground plane and the antenna. The expression "above" shows a positional relation using, as a reference, the case where the finite ground plane is positioned below, and is not limited to an expression "above" in the vertical direction. The "above" is a concept including the case where two elements are in contact with each other.

Figure 1B:
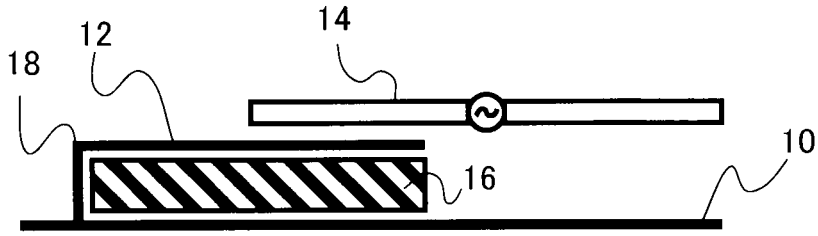
Figure 1C:
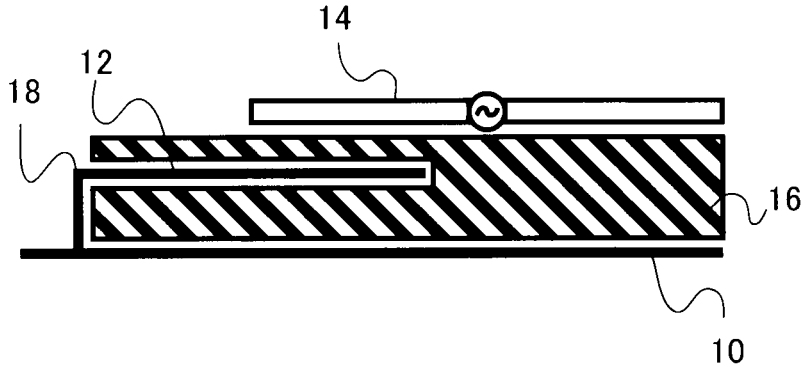

FIGS. 1A to 1C are configuration diagrams of an antenna device of a first embodiment of the present invention. FIG. 1A is a perspective view, FIG. 1B is a cross section, and FIG. 1C is a cross-sectional view of a modification.

The antenna device has a finite ground plane 10, a rectangular conductor plate 12 provided above the finite ground plane 10, an antenna 14 disposed in substantially parallel with the finite ground plane 10 above the finite ground plane 10, and a magnetic material 16 provided in at least a part of space between the finite ground plane 10 and the antenna 14. In FIGS. 1A to 1C, the magnetic material 16 is inserted between the finite ground plane 10 and the rectangular conductor plate 12. In FIG. 1A, the magnetic material 16 is shown separately from the antenna device so that the configuration of the antenna device is easily seen.

FIG. 1B shows that spaces are provided between the magnetic material 16 and the finite ground plane 10 and between the magnetic material 16 and the rectangular conductor plate 12. However, to increase the effect of insertion of the magnetic material 16, it is more preferable to eliminate the spaces and make the magnetic material 16 in contact with the finite ground plane 10 and the rectangular conductor plate 12. Further, in FIG. 1B, the magnetic material 16 is inserted only between the rectangular conductor plate 12 and the finite ground plane 10. The magnetic material 16 may be inserted so as to extend from the rectangular conductor plate 12 to a part of the antenna 14, or inserted also between the antenna 14 and the rectangular conductor plate 12 as shown in a modification of FIG. 1C.

From the viewpoint of adhesion between the magnetic material 16 and the finite ground plane 10, the rectangular conductor plate 12, and the antenna 14, it may be necessary to interpose another material in each of the spaces. In such a case, more preferably, in the space between the finite ground plane 10 and the antenna 14, the space other than the space occupied by the magnetic material is occupied by a dielectric material, and a combination of a dielectric and a magnetic material having the same refractive index as that of the occupying dielectric and magnetic material is chosen.

In the case of using only the magnetic material or a combination of a magnetic material and a dielectric one having different refractive indexes, reflection of electric waves occurs in the interface between the magnetic material and air or in the interface between the magnetic material and the dielectric. When there is a loss in the magnetic material or the dielectric, the radiation efficiency of the antenna device deteriorates. Also when there is no loss, the reflection causes narrowing of the band. By making the refractive index in the space constant, unnecessary electric wave reflection can be suppressed, the deterioration in the radiation efficiency can be suppressed. The discussion is similarly made also for FIGS. 3B, 3C, and 6.

The finite ground plane 10 and the rectangular conductor plate 12 are made of a conductive material. One side of the rectangular conductor plate 12 is connected to the finite ground plane 10 and is electrically short-circuited. The rectangular conductor plate 12 has a bent portion 18 substantially parallel with the one side. The antenna 14 is provided above the rectangular conductor plate 12, and extends in a direction substantially perpendicular to the one side of the rectangular conductor plate 12 connected to the finite ground plane 10. A feeding point 22 of the antenna 14 is positioned near the other side opposite to the one side of the rectangular conductor plate 12. In FIGS. 1A to 1C, the antenna 14 is a dipole antenna.

The bent portion 18 of the rectangular conductor plate 12 can be formed by bending a rectangular conductor plate. Alternatively, in place of bending, two rectangular conductor plates which are electrically equivalent may be prepared and physically and electrically connected by a method such as soldering. In the antenna device of FIGS. 1A to 1C, the bent portion 18 of the rectangular conductor plate 12 has a right angle and is constructed by a part parallel to the finite ground plane 10 and a part perpendicular to the finite ground plane 10. The structure, however, is not essential. As long as electromagnetic wave propagation under the rectangular conductor plate 12 is obtained, it is not always necessary to provide the structure. That is, it is not always necessary to bend the rectangular conductor plate 12 at the right angle or provide a part parallel or perpendicular to the finite ground plane 10.

The sentence "the feeding point 22 of the antenna 14 is positioned near the other side opposite to the one side of the rectangular conductor plate 12" means that the position of the feeding point 22 is in the range of less than ⅙ electromagnetic wavelength of the operation frequency of the antenna 14 from the other side. As will be described later, the reason is that the adjustment position of the feeding point 22 for antenna matching lies in the range.

FIGS. 1A to 1C show the case where the antenna 14 is a dipole antenna. The dipole antenna in FIGS. 1A to 1C is obtained by linearly arranging two linear conductors and feeding power to the center of the conductors.

Figure 2:
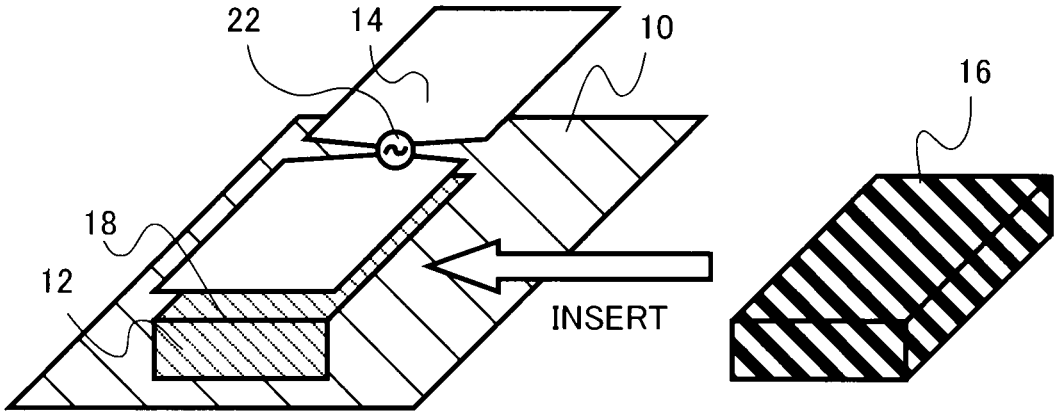
FIG. 2 is a configuration diagram of a first modification of the antenna device of the first embodiment.

FIG. 2 is a configuration diagram of a first modification of the antenna device of the embodiment. In the modification, as the antenna 14, a plate dipole antenna is applied. The plate dipole antenna is one of varieties of the dipole antenna, in which power is fed to the center of two conductor plates arranged and sides close to the feeding point 22, of the conductor plates are obliquely cut so that the interval between the two conductor plates widens with distance from the feeding point 22. The plate dipole antenna has an advantage that a band wider than that of a dipole antenna using linear conductors can be realized.

Figure 3A:
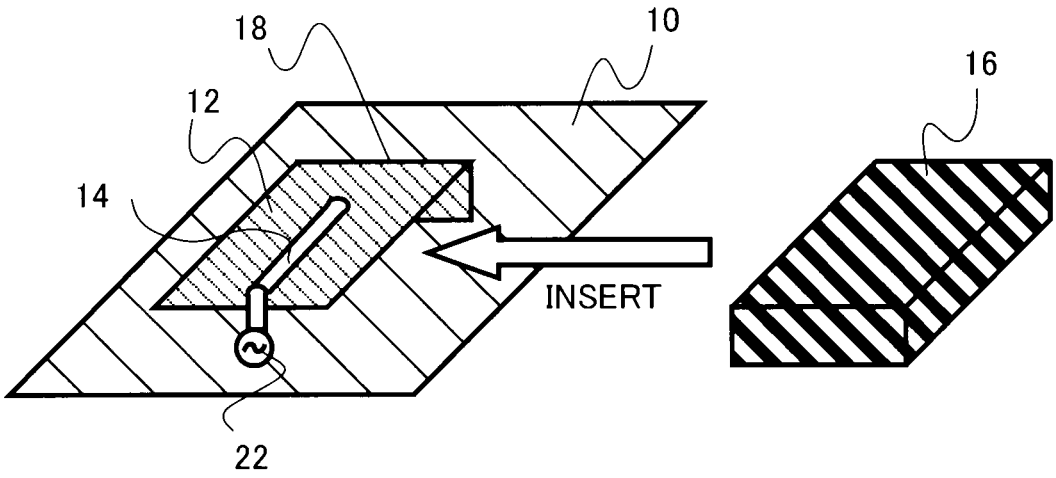
FIGS. 3A to 3C are configuration diagrams of a second modification of the antenna device of the first embodiment.
Figure 3B:
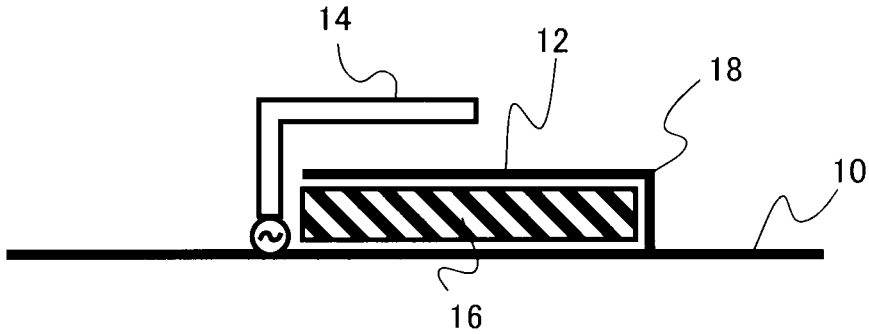
Figure 3C:
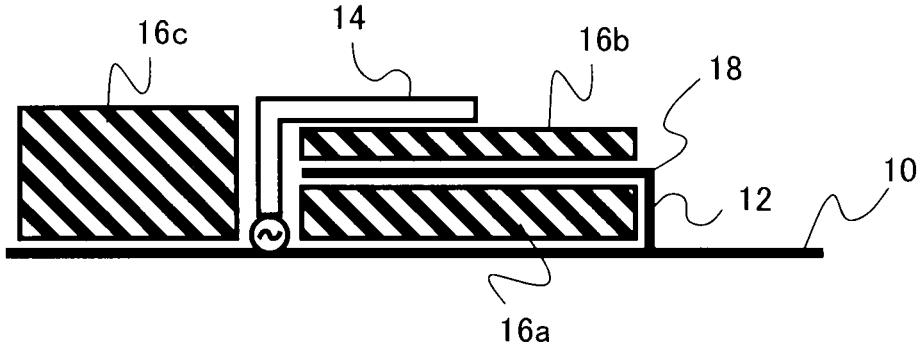

FIGS. 3A to 3C are configuration diagrams of a second modification of the antenna device of the embodiment. FIG. 3A is a perspective view, FIG. 3B is a cross section, and FIG. 3C shows another modification of the second modification. In the modification, a monopole antenna is used as the antenna 14. Different from the dipole antenna of FIGS. 1A to 1C, the monopole antenna does not have a linear conductor on the side far from the rectangular conductor plate 12 and is obtained by bending the feeding point 22 side so that the feeding point 22 is positioned on the finite ground plane 10. To realize further miniaturization of the antenna device, the monopole antennal is more preferable than the dipole antenna.

As shown in FIGS. 1A, 1B, 2, 3A, and 3B, the magnetic material 16 is inserted between at least a part of the space between the antenna 14 and the rectangular conductor plate 12, for example, between the rectangular conductor plate 12 and the limited bottom plate 10.

With the configuration, the antenna device of the embodiment can obtain impedance matching even in the case of realizing miniaturization including lower profile, and broadband property can be obtained. The action and effect of the embodiment will be described in detail below.

Figures 4A, 4B, 4C:
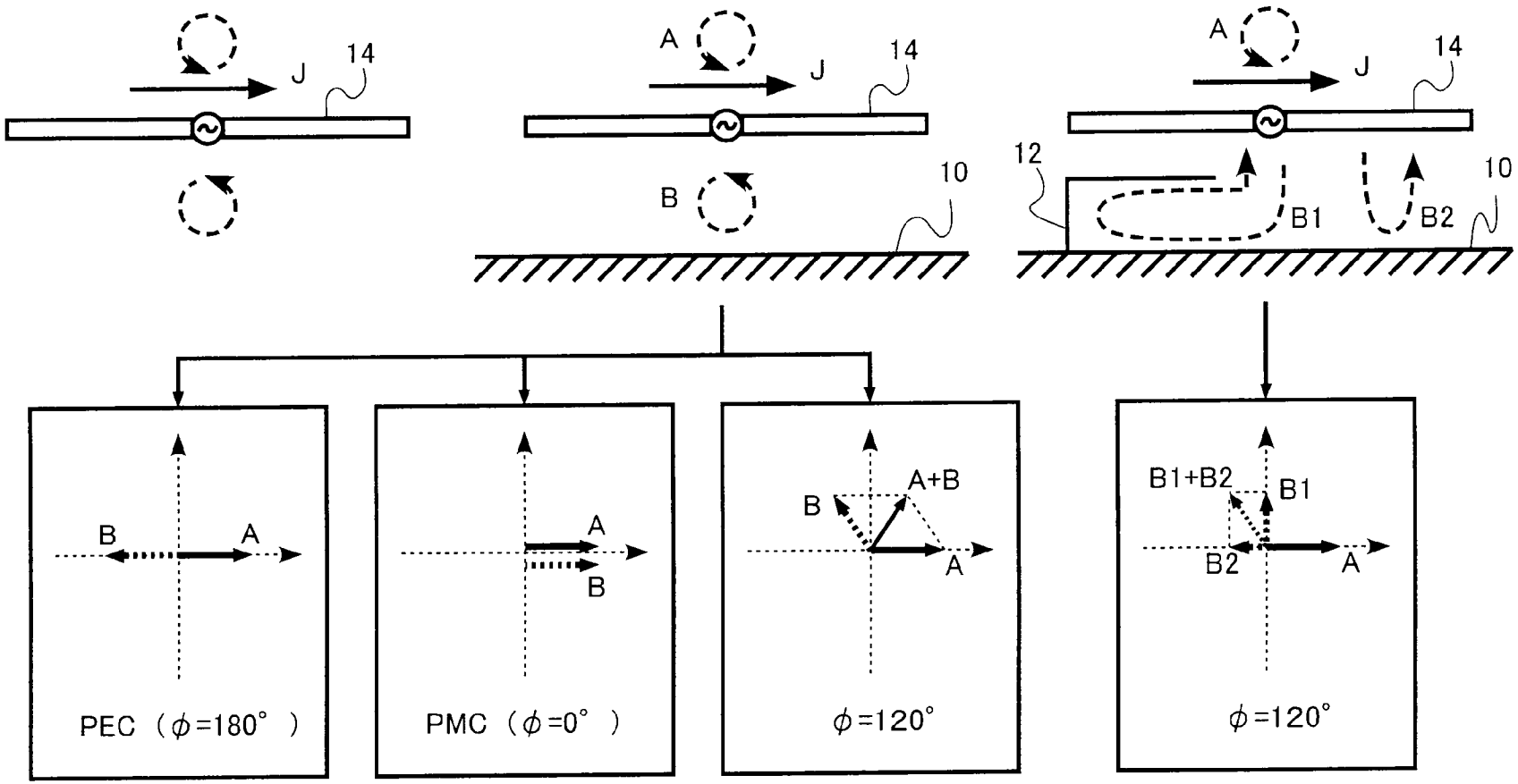
FIGS. 4A to 4C are explanatory diagrams of an operation principle of the antenna device of the first embodiment.

FIGS. 4A to 4C are explanatory diagrams of the operation principle in the case where the magnetic material is not inserted in the antenna device of the embodiment. FIG. 4A shows the case where an antenna exists in a free space. FIG. 4B shows the case where the antenna exists above the finite ground plane. FIG. 4C shows the case where the rectangular conductor plate exists.

As shown in FIG. 4A, when current J flowing above the dipole antenna 14 in the free space is assumed, a voltage $V_0$ is generated at the feeding point by an electric field generated by the current J. By the current J and the voltage $V_0$, input impedance $Z_0=V_0/J$ of the dipole antenna 14 is obtained. It is known that the input impedance is about 72Ω in the case of a half-wave dipole antenna.

FIG. 4B shows the case where the dipole antenna 14 is disposed above the finite ground plane 10 in parallel with the finite ground plane 10. Electric fields generated by the current J are two electric fields; an electric field A generated on the semi-infinite free space side upper than the dipole antenna 14, and an electric field B generated by being reflected by the finite ground plane 10 below the dipole antenna 14.

The impedance obtained by forming the dipole antenna 14 in a lower profile varies according to a reflection phase $\phi$ at the reflection point. In the case of PEC (Perfect Electric Conductor) in which the reflector has a property close to a metal, $\phi$ is equal to 180 degrees. At the limit of the low profile, that is, in a state where the antenna is close to the reflector to the maximum, no voltage is generated, and the input impedance is zero. In the case where the reflector is a PMC (Perfect Magnetic Conductor), $\phi$ is zero. At the limit of the low profile, a voltage twice as large as that in the free space is generated, and the input impedance is $2Z_0$.

When it is assumed that $\phi$=120 degrees=$2\pi/3$ rad, by the relational expression $$\exp(j\omega t)+\exp\{j(\omega t\pm 2\pi/3)\}=\exp\{j(\omega t\pm\pi/3)\},$$

the input impedance becomes $Z_0$ which is the same as that in the free space.

The lower part of FIG. 4B is a diagram showing the relation between the reflection phase and the voltage with phasors. A phasor expresses a change in an AC signal by a vector in a complex plane. From a real part or an imaginary part of a phasor, the amplitude of actual voltage is known. The left diagram in the lower part shows a state where a phasor of an electric field generated by the electromagnetic wave of a path A and a phasor of an electric field generated in a path B reflected by the PEC cancel out each other at a phase difference of 180 degrees. The second diagram from the left in the lower part shows that reflection of the same phase occurs by the PMC and double voltages are generated. The third diagram from the left in the lower part shows that the amplitude of the voltage is not changed by reflection of the phase difference of 120 degrees.

FIG. 4C is a cross-sectional view of a state where the magnetic material is eliminated from the antenna device of the embodiment. Since the rectangular conductor plate 12 is short-circuited to the finite ground plane 10, resonance occurs at a frequency at which the shortest distance from the short-circuit point to an open end is about a quarter wave. At a resonance frequency of the rectangular conductor plate 12, the electromagnetic wave in the path propagating below the rectangular conductor plate 12 shown by B1 in FIG. 4C becomes dominant in power. At this time, if the rectangular conductor plate 12 has a sufficiently low profile, a part below the rectangular conductor plate 12, of the path B1 corresponds an substantially half wavelength in a round trip. That is, during a round trip below the rectangular conductor plate 12, the phase changes by about 180 degrees.

Further, a reflection phase of 180 degrees is generated in a portion perpendicular to the limited bottom plate 10, of the rectangular conductor plate 12. Consequently, during a round trip below the rectangular conductor plate 12 in the path B1, the phase difference of about 360 degrees (=zero degree) occurs. The phase difference corresponds to the case of the PMC. Further, when the feeding point of the antenna is positioned apart from the tip of the rectangular conductor plate 12 by about ⅙ of a wavelength, the phase difference of 120 degrees is obtained in addition to the phase difference of 360 degrees (=zero degree).

In such a manner, the phase difference of 360 degrees is obtained by the rectangular conductor plate 12, and the phase difference of 120 degrees is obtained by disposing the rectangular conductor plate 12 and the tip of the dipole antenna 14 so as to be apart from each other. By the mechanism described above, the input impedance equivalent to that in the free space can be obtained.

The lower part of FIG. 4C is a diagram showing the relation between the reflection phase and the voltage with phasors. The power in the propagation path B1 of the electromagnetic wave generated by resonance of the rectangular conductor plate 12 is dominant. However, in the case where reflection B2 of a short distance from the top face of the finite ground plane 10 or the rectangular conductor plate 12 cannot be ignored, as shown by the lower diagram of FIG. 4C, by setting the feeding point of the dipole antenna 14 close to the tip of the rectangular conductor plate 12 in order to shift the reflection phase of the path B1 to the zero-degree side, the phase difference of composite waves of the paths B1 and B2 can be made to 120 degrees.

The space below the rectangular conductor plate 12 can be regarded as a parallel plate line. Consequently, the wider the space is, the more superposition of propagations in oblique directions (hereinbelow, called propagation mode) is excited, and the amplitude for frequency varies among the propagation modes. Therefore, the band of the antenna device can be made broader easily.

Figure 5:
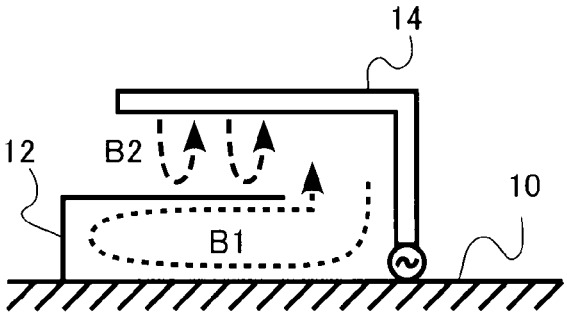
FIG. 5 is a cross-sectional view of the antenna device in the case of using a monopole antenna in the first embodiment.

FIG. 5 is a cross-sectional view of an antenna device in the case of using a monopole antenna. In a manner similar to the description of the operation principle of the case using the dipole antenna, the rectangular conductor plate 12 resonates at a specific frequency. At the frequency, the electromagnetic wave in the path B1 that travels below the rectangular conductor plate 12 and is reflected at a phase of 120 degrees is dominant. Therefore, the input impedance of the monopole antenna 14 becomes substantially the same as the input impedance when there is nothing below the monopole antenna 14 of the finite ground plane 10. That is, the input impedance is equivalent to that in free space.

Also in the case where the power of the electromagnetic wave in the path B2 that is directly reflected at a short distance by the top face of the limited bottom plate 10 and the rectangular conductor plate 12 below the monopole antenna 14 cannot be ignored, by setting the feeding point of the monopole antenna 14 close to the open end of the rectangular conductor plate 12, the phase difference of composite waves of the paths B1 and B2 can be made 120 degrees in a manner similar to the case of the dipole antenna.

As described above, by providing the antenna device with a rectangular conductor plate, even the profile is low, the input impedance equivalent to that in the free space is obtained and the antenna matching can be obtained. Further, the rectangular conductor plate is linearly short-circuited at one side of the rectangular conductor plate to the finite ground plane. With the structure, the rectangular conductor plate can have current path distributions having various lengths of current in a path obliquely provided for the rectangular conductor plate and current in a shortest path in the short-circuit direction. Therefore, the reflection phase of 120 degrees can be maintained in a wide frequency band, and the band of the antenna device can be broadened.

Further, in the embodiment, by inserting the magnetic material in at least part of the space between the antenna and the finite ground plane, further miniaturization and broader band can be realized. The reason is that the wavelength shortening effect is produced by the permittivity and the magnetic permeability of the magnetic material, the resonance frequency is lowered, and the antenna can be miniaturized. In addition, the broader band is realized by the magnetic permeability of the magnetic material.

FIG. 3C shows another modification of the second modification of the embodiment. From the viewpoint of further miniaturization and broader band, it is preferable to insert and dispose as many magnetic materials as possible in the spaces between and around the antenna 14 and the finite ground plane 10 like magnetic materials 16*a*, 16*b*, and 16*c*. FIGS. 1A to 1C, 2, and 3A to 3C show that spaces are provided between the magnetic material 16 and the finite ground plane 10, the rectangular conductor plate 12, and the antenna 14. However, to increase the effect of insertion of the magnetic material 16, it is more preferable to eliminate the spaces and make the magnetic material 16 in contact with the finite ground plane 10, the rectangular conductor plate 12, and the antenna 14.

From the viewpoint of adhesion between the magnetic material 16 and the finite ground plane 10, the rectangular conductor plate 12, and the antenna 14, it may be necessary to interpose another material in each of the spaces. In such a case, more preferably, in the space between the finite ground plane 10 and the antenna 14, the space other than the space occupied by the magnetic material is occupied by a dielectric material, and a combination of a dielectric and a magnetic material having the same refractive index as that of the occupying dielectric and magnetic material is chosen.

In the case of using only the magnetic material or a combination of a magnetic material and a dielectric one having different refractive indexes, reflection of electric waves occurs in the interface between the magnetic material and air or in the interface between the magnetic material and the dielectric, and it causes deterioration in the radiant efficiency of the antenna device. By making the refractive index in the space constant, unnecessary electric wave reflection can be suppressed, the deterioration in the radiant efficiency can be suppressed.

For miniaturization of the antenna device and broader band, the thickness of the magnetic material to be inserted is preferably 10 μm or more and, more preferably, 100 μm or more. The thicker is the better. To suppress a loss caused by induced current, preferably, electrical resistance of the magnetic material is large. Preferably, the magnetic material has an electrical resistance value equivalent to that of a general oxide.

The magnetic material used for the embodiment will now be described in detail. First, the configuration of the magnetic material will be described. The magnetic material of the embodiment has a core-shell magnetic particle and an insulating material in which the particles are dispersed and there are air gaps. The magnetic material having the configuration is preferable for miniaturization of the antenna device and broader band. The embodiment is not always limited to the configuration of the magnetic material. A large number of the air gaps are preferable from a view point of light weight and low permittivity of the magnetic material. On the other hand, a small number of the air gaps are preferable from a view point of improvement of permeability and strength of the magnetic material and prevention of oxidation of the core-shell magnetic particles. Consequently, preferable amount of the air gaps in the magnetic material is between 0.1 vol % and 85 vol %. Shapes and size may adequately be selected.

Preferably, the core-shell magnetic particles have filling ratio (volume fraction) in the whole magnetic material in a range of 10 vol % to 70 vol %. When the filling ratio exceeds 70 vol %, electrical resistance of the magnetic material becomes small, eddy-current loss increases, and there is the possibility that the high-frequency magnetic property deteriorates. When the filling ratio is lower than 10 vol %, the filling ratio of the magnetic metal decreases, saturation magnetization of the magnetic material decreases, and there is the possibility that magnetic permeability drops.

Preferably, the insulating material has filling ratio of 5 vol % to 80 vol % in the magnetic material. When the filling ratio is less than 5 vol %, there is the possibility that the particles cannot be bonded to each other and the intensity of the magnetic material deteriorates. When the filling ratio exceeds 80 vol %, there is the possibility that the volume fraction in the entire magnetic material of the core-shell magnetic particles drops, and the magnetic permeability drops.

The insulating material is a resin, an inorganic material, or the like. The resin is, though it is not limited, polyester resin, polyethylene resin, polystyrene resin, polyvinyl chloride resin, polyvinyl butyral resin, polyurethane resin, cellulosic resin, ABS resin, nitrile-butadiene rubber, styrene-butadiene rubber, epoxy resin, phenol resin, amide resin, imide resin, fluorine resin, or copolymers of the resins. The inorganic material is ceramics, glass or the like of oxide, nitride, or carbide. The inorganic material is an oxide containing at least one metal selected from the group of Mg, Al, Si, Ca, Zr, Ti, Hf, Zn, Mn, rare-earth element, Ba, and Sr, such as AlN, $Si_3N_4$, SiC or the like.

In a method of integrating the core-shell magnetic particles into a sheet shape, though it is not limited, for example, core-shell magnetic particles, a resin, and a solvent are mixed to obtain slurry, and the slurry is applied and dried. It is also possible to press a mixture of core-shell magnetic particles and a resin and form the mixture in a sheet shape or pellet shape. Further, the core-shell magnetic particles may be dispersed in a solvent and deposited by a method such as electrophoresis.

The magnetic material may be, for example, a stack magnetic material formed by a magnetic layer and a non-magnetic dielectric layer. The magnetic layer is not simply stacked but is stacked while sandwiching the non-magnetic dielectric layer, thereby disconnecting magnetic coupling and reducing the influence of a demagnetizing field as a total bulk. That is, by interposing the non-magnetic dielectric layer between the magnetic layers, magnetic coupling between the magnetic layers is interrupted to reduce the size of the magnetic pole, so that the influence of the demagnetizing field can be reduced. Further, the thickness of the magnetic layer can be substantially increased, so that the magnetic characteristic (magnetic permeability×thickness) of the total bulk can be improved.

As described above, a magnetic layer containing the core-shell magnetic particles is formed in a sheet having a thickness of 100 μm or less. The sheet-shaped magnetic layer is alternately stacked with a non-magnetic dielectric layer having a thickness of 100 μm or less. After that, the stacked layers are pressure-bonded, heated, and sintered to thereby obtain a stack structure. In such a manner, the high-frequency magnetic characteristic of the magnetic material improves.

The magnetic permeability and the permittivity of the magnetic material are determined by the components of the magnetic material, that is, the core-shell magnetic particles, the insulating material and their filling ratios. Each of the magnetic permeability and the permittivity capable of realizing a low loss at hundreds MHz to a few GHz is in a range of 1 to 10.

In the case of assembling the magnetic material in the antenna device, the degree of miniaturization of the antenna tends to be substantially proportional to the square root of the product of the magnetic permeability and the permittivity of the magnetic material. The degree of broadening the band of the antenna tends to be substantially proportional to the square root of the magnetic permeability of the magnetic material and tends to be substantially inversely proportional to the square root of the permittivity.

Therefore, in the case where each of the magnetic permeability and the permittivity is in the range of 1 to 10, the product of the permittivity and the magnetic permeability is large, so that a wavelength shortening effect is large, and contribution to miniaturization is large. As compared with the case of using only the dielectric material, the broader band is realized because of the effect of the magnetic permeability. More preferably, the magnetic permeability is higher than the permittivity.

For example, in the case of using core-shell magnetic particles, two kinds of the particles, a kind in which the magnetic permeability is in the range of 1 to 5 and the magnetic permeability is higher than the permittivity, and a kind in which the magnetic permeability is lower than the permittivity, can be combined. In the former case that the magnetic permeability is higher than the permittivity, contribution to broaden the band of the antenna is large. Since the product of the permittivity and the magnetic permeability is not so large, the wavelength shortening effect is not so large, and the contribution to miniaturization is not so much. However, obviously, miniaturization can be performed more than the case of using only the dielectric material. On the other hand, in the latter case that the magnetic permeability is lower than the permittivity, the band can be broadened more than the case of using only the dielectric material. However, contribution to broaden the antenna is not so large. The wavelength shortening effect is large and contribution to miniaturization is large.

From the above, it is required to totally judge demands for miniaturization and broader band and select the magnetic permeability and permittivity of the magnetic material. As described above, it can be easily controlled by the components of the magnetic material, that is, the core-shell magnetic particles and the insulating material and filling ratios of the components.

Next, the core-shell magnetic particle as one of the components of the magnetic material will be described. The core-shell magnetic particle includes a core of a magnetic metal particle as a metal nano particle and a shell of an oxide coating layer covering the surface of the magnetic metal particle. The magnetic metal particle contains a magnetic material containing at least one metal selected from the group of Fe, Co, and Ni, at least one non-magnetic metal selected from the group of Mg, Al, Si, Ca, Zr, Ti, Hf, Zn, Mn, rare-earth element, Ba, and Sr, and at least one element selected from carbon and nitrogen. The oxide coating layer is made of, preferably, an oxide containing at least a non-magnetic metal as one of components of the magnetic metal particles. The oxide may be a composite oxide containing two or more metals.

The magnetic metal contained in the magnetic metal particle contains at least one metal selected from the group of Fe, Co, and Ni. In particular, an Fe-base alloy, a Co-base alloy, and an FeCo-base alloy are preferable since they can realize high saturation magnetization. Examples of the Fe-base alloy are FeNi alloy, FeMn alloy and FeCu alloy containing, as a second component, Ni, Mn, and Cu, respectively. Examples of the Co-base alloy are CoNi alloy, CoMn alloy, and CoCu alloy containing, as a second component, Ni, Mn, and Cu, respectively. Examples of the FeCo-base alloy are alloys containing Ni, Mn, and Cu as a second component. The second components are effective components to improve the high frequency magnetic characteristic of the core-shell magnetic particle.

Among magnetic metals, it is particularly preferable to use an FeCo-base alloy. The Co amount in FeCo is preferably set to a range of 10 atomic % to 50 atomic % from the viewpoint of satisfying thermal stability, oxidation resistance, and high saturation magnetization. The Co amount in FeCo is, more preferably, in the range of 20 atomic % to 40 atomic %, from the viewpoint of increasing saturation magnetization.

Preferably, the magnetic metal particle contains a non-magnetic metal. The non-magnetic metal contained in the magnetic metal particle is at least one non-magnetic metal selected from the group of Mg, Al, Si, Ca, Zr, Ti, Hf, Zn, Mn, rare-earth element, Ba, and Sr. Those non-magnetic metals are elements having small standard Gibbs energy of formation of the oxidation and easy to be oxidized, and are preferable elements from the viewpoint of increasing stability of insulating property of the oxide coating layer as a shell coating the core of the magnetic metal particle. In other words, a metal having large standard Gibbs free energy of formation easily becomes an oxide and is not preferred.

Since the oxide coating layer of the shell is made of an oxide or composite oxide containing at least one of non-magnetic metals as one of components of the magnetic metal particles of the core, adhesion and bonding between the magnetic metal particle and the oxide coating layer of the shell increases, and the material becomes also thermally stable. Particularly, Al and Si are preferable since they are easily dissolved with Fe, Co, and Ni as main components of the magnetic metal particle, so that it contributes to improvement in the thermal stability of the core-shell magnetic particle. In particular, the case of using Al is preferable for the reason that the thermal stability and oxidation resistance. The invention includes a dissolved form of a composite oxide containing a plurality of kinds of non-magnetic metals.

The oxide coating layer has, preferably, a thickness of 0.1 nm to 100 nm and, more preferably, a thickness of 0.1 nm to 20 nm. When the thickness of the oxide coating layer is less than 0.1 nm, oxidation resistance is insufficient. At the time of integrating the core-shell magnetic particles coated with the oxide coating layer to manufacture a desired material, the electrical resistance of the material decreases, eddy-current loss tends to occur, and there is the possibility that the high-frequency property of the magnetic permeability deteriorates. On the other hand, when the thickness of the oxide coating layer exceeds 100 nm, at the time of integrating the core-shell magnetic particles coated with the oxide coating layer to produce a desired material, the filling ratio of the magnetic metal particles included in the material decreases only by the amount of thickness of the oxide coating layer. There is the possibility that saturation magnetization of the material decreases, and magnetic permeability drops.

In the magnetic metal particle, preferably, carbon and/or nitrogen is contained. At least one of carbon and nitrogen is dissolved with the magnetic metal, thereby enabling the magnetic anisotropy of the core-shell magnetic particle to be increased. The magnetic material containing the core-shell magnetic particle having such large magnetic anisotropy can make ferromagnetic resonance frequency higher, and can become a material suitable for use in the high frequency band. That is, the magnetic permeability imaginary part ($\mu''$) in the high frequency band can be decreased, so that the material is suitable for use in the high frequency band.

Preferably, the magnetic metal particle contains, in addition to the magnetic metal, 0.001 atomic % to 20 atomic % of the nonmagnetic metal to the above magnetic metal and 0.001 atomic % to 20 atomic % of at least one element selected from carbon and nitrogen to the above magnetic metal. When each of the content of the nonmagnetic metal and the content of at least one element selected from carbon and nitrogen exceeds 20 atomic %, the saturation magnetization of the magnetic particle may deteriorate. When each of the contents becomes less than 0.001 atomic %, it is feared that an effect of excellently maintaining magnetic anisotropy, thermal stability, and oxidation resistance cannot be obtained.

In particular, in the magnetic metal particle containing an FeCo-base alloy as the magnetic metal, Al as the nonmagnetic metal, and carbon (C) as the element, Al of, preferably, 0.001 atomic % to 5 atomic %, more preferably, 0.01 atomic % to 5 atomic % with respect to the FeCo-base magnetic metal is contained, and carbon of, preferably, 0.001 atomic % to 5 atomic %, more preferably, 0.01 atomic % to 5 atomic % with respect to the FeCo-base magnetic metal is contained. In the case where the magnetic metal is an FeCo-base alloy, 0.001 atomic % to 5 atomic % of Al is contained, and 0.001 atomic % to 5 atomic % of carbon is contained, particularly, magnetic anisotropy and saturation magnetization can be maintained excellently, so that the magnetic permeability in higher frequency can be increased.

Preferably, at least two elements of the magnetic metal, the nonmagnetic metal, and the element such as carbon or nitrogen contained in the magnetic metal particle are solid-solved with each other. By the solid solution, magnetic anisotropy can be effectively improved, so that the high frequency magnetic characteristic can be improved. In addition, the mechanical characteristic of the core-shell magnetic particle can be improved. That is, when the elements are not solid-solved but segregate on the grain boundary and the surface of the magnetic metal particle, it may become difficult to effectively improve the magnetic anisotropy and the mechanical characteristic.

The magnetic metal particle may be in the form of polycrystal or single crystal. Preferably, the magnetic metal particle is in the form of single crystal. At the time of integrating the core-shell magnetic particles including magnetic metal particles of single crystal to form a magnetic material, magnetization easy axes can be aligned and magnetic anisotropy can be controlled. Therefore, the high frequency characteristic can be improved as compared with a magnetic material containing core-shell magnetic particles including magnetic metal particles of polycrystal.

Average particle diameter of the magnetic metal particle is 1 nm to 1,000 nm, preferably, 1 nm to 100 nm, and more preferably, 10 nm to 50 nm. When the average particle diameter is less than 10 nm, there is the possibility that super paramagnetism occurs and magnetic flux content decreases. On the other hand, when the average particle diameter exceeds 1,000 nm, there is the possibility that an eddy-current loss increases in the high frequency area and the magnetic characteristic in the target high frequency area deteriorates.

In the core-shell magnetic particle, a magnetic metal particle having a multiple-magnetic-domain structure is stabler than that having a single-domain structure from the viewpoint of energy. The high frequency characteristic of the magnetic permeability of the core-shall magnetic particle including the magnetic metal particle having the multiple-magnetic-domain structure is lower than that including the magnetic metal particle having the single-domain structure. For such a reason, in the case of using the core-shell magnetic particle as a magnetic particle for high frequencies, preferably, it exists as a magnetic metal particle having the single-domain structure.

Since the critical particle diameter of the magnetic metal particle having the single-domain structure is about 50 nm or less, it is preferable to set the average particle diameter of the magnetic metal particle to 50 nm or less. Based on the above points, average particle diameter of the magnetic metal particle is 1 nm to 1,000 nm, preferably, 1 nm to 100 nm, and more preferably, 10 nm to 50 nm.

The magnetic metal particle may have a spherical shape but preferably has a flat shape or a rod shape having a high aspect ratio (for example, 10 or greater). The rod shape includes a spheroid. The "aspect ratio" refers to the ratio of height to diameter (height/diameter). In the case of a spherical shape, the height and the diameter are equal to each other, so that the aspect ratio is 1. The aspect ratio of the flat particle refers to (diameter/height). The aspect ratio of the rod shape refers to (length of the rod/diameter of the bottom face of the rod). The aspect ratio of a spheroid refers to (long axis/short axis). When the aspect ratio is set to be high, magnetic anisotropy by the shape can be given, and the high frequency characteristic of the magnetic permeability can be improved. Moreover, at the time of fabricating a desired material by integrating core-shell magnetic particles, the particles can be easily aligned by a magnetic field. Further, the high frequency characteristic of the magnetic permeability can be improved. By setting the aspect ratio to be high, the critical particle diameter of the magnetic metal particle having the single-domain structure can be increased to, for example, a value exceeding 50 nm.

In the case of a spherical magnetic metal particle, the critical particle diameter in the single-domain structure is about 50 nm. The critical particle diameter of the flat magnetic metal particle having a high aspect ratio can be increased, and the high frequency characteristic of the magnetic permeability does not deteriorate. Generally, particles having a larger particle diameter are easy to synthesize. From the viewpoint of manufacture, a particle having a high aspect ratio is advantageous. Further, by setting the aspect ratio to be higher, at the time of manufacturing a desired material by integrating the core-shell magnetic particles including the magnetic metal particles, the filling ratio can be increased. Consequently, saturation magnetization per volume and per weight of a material can be increased. As a result, the magnetic permeability can be set to be higher.

An oxide coating layer for coating the surface of the magnetic metal particle is made of an oxide containing at least one of the non-magnetic metal as one of the components of the magnetic metal particle. The oxide coating layer improves oxidation resistance of an internal magnetic metal particle. At the time of manufacturing a desired material by integrating the core-shell magnetic particles coated with the oxide coating layer, the magnetic particles are electrically isolated and the electric resistance of the material can be increased. By increasing the electric resistance of the material, an eddy-current loss at high frequencies is suppressed, and the high frequency characteristic of the magnetic permeability can be improved. Consequently, the oxide coating layer has, preferably, electrically high resistance. Preferably, the oxide coating layer has a resistance value of, for example, 1 mΩ·cm or more.

In the core-shell magnetic particles in the foregoing embodiment, the magnetic metal particle containing a magnetic metal containing at least one element selected from the group of Fe, Co, and Ni, the nonmagnetic metal, and at least one element selected from carbon and nitrogen has high saturation magnetization. An oxide coating layer coated on the surface of the magnetic metal particle and made of an oxide containing at least one nonmagnetic metal as one of the components of the magnetic metal particle has high insulation. By coating the surface of the magnetic metal particle having high saturation magnetization with the oxide coating layer having high insulation, an eddy-current loss as a cause of a loss at high frequencies can be suppressed, and the core-shell magnetic particle having high anisotropy field can be obtained.

The magnetic material containing such a core-shell magnetic particle displays an excellent magnetic characteristic in which the magnetic permeability, that is, the magnetic permeability real part (μ') and the magnetic permeability imaginary part (μ") can be controlled at high frequencies in the range from 100 MHz to GHz, and has thermal stability of the excellent magnetic characteristic for long time. Concretely, the magnetic material hardly has a loss other than a ferromagnetic resonance loss. The magnetic material has high magnetic permeability at high frequencies, and the ferromagnetic resonance frequency reaches a few GHz. Consequently, in a frequency band lower than the ferromagnetic resonance frequency, a high magnetic permeability real part (μ') and a low magnetic permeability imaginary part (μ") are displayed. The magnetic material can be effectively used as a high-magnetic-permeability part inserted in the space between the antenna and the finite ground plane.

The composition analysis of the magnetic metal particle can be performed by, for example, the following method. For analysis of the nonmagnetic metal such as Al, the ICP emission spectrometry, TEM-EDX, XPS, SIMS, or the like can be used. In the ICP emission spectrometry, by comparing analysis results of a magnetic metal particle (core) part dissolved with weak acid or the like, a residual (oxide shell) dissolved with alkali, strong acid, or the like, and the entire particle, the composition of the magnetic metal particle can be recognized. That is, the amount of the nonmagnetic metal in the magnetic metal particle can be measured. In the TEM-EDX, an EDX is emitted while narrowing a beam to the magnetic metal particle (core) and the shell and the semi-quantitative analysis is performed, thereby enabling the composition of the magnetic metal particle to be roughly recognized. Further, by the XPS, a coupling state of elements of the magnetic metal particle can be also examined. For example, it is hard for an element such as carbon to solid-solved in the shell part. Consequently, it is considered that the element is solid-solved on the core side as the magnetic metal particle. By analyzing the composition of the entire magnetic metal particle by the ICP emission spectrometry, the element can be measured. By such a magnetic metal particle composition analysis, a small amount of the nonmagnetic metal such as Al or the element such as carbon in the magnetic metal particle can be measured.

In the core-shell magnetic particle of the embodiment and the magnetic material using the same, the material organization can be determined (analyzed) by the SEM (Scanning Electron Microscopy), or TEM (Transmission Electron Microscopy). A diffraction pattern (including recognition of solid solution) can be analyzed by TEM diffraction or XRD (X-ray Diffraction). Identification of an element and quantitative analysis can be performed by the ICP (Inductively Coupled Plasma) emission analysis, fluorescent X-ray analysis, EPMA (Electron Probe Micro-Analysis), EDX (Energy Dispersive X-ray Fluorescence Spectrometer), SIMS (Secondary Ion Mass Spectrometry), or the like. An average particle diameter of the magnetic metal particle can be obtained as follows. By TEM observation or SEM observation, the longest diagonal line and the shortest diagonal line of the particles are averaged and the average is used as the particle diameter. The average particle diameter can be obtained from an average of a number of particle diameters.

Experiment examples of the core-shell magnetic particle of the embodiment and the magnetic material using the same will be described below more specifically with a comparative experiment. An average crystal grain size of a magnetic metal particle in the following experiments and the comparative experiment was measured on the basis of the TEM observation. Concretely, the longest and shortest diagonal lines of each particle taken by the TEM observation (micrograph)

were averaged. The average was used as the particle diameter. By averaging particle diameters, the average crystal grain size was obtained. Three or more sections each made of a unit area of 10 μm×10 μm in a micrograph were extracted and an average was calculated. The composition of a microstructure was analyzed on the basis of the EDX analysis.

Experimental Example 1

Argon as plasma generation gas was introduced at 40 L/min into a chamber in a high-frequency induction thermal plasma apparatus to generate plasma. Fe powders having an average particle diameter of 10 μm and Al powders having an average particle diameter of 3 μm as the material were injected together with argon (carrier gas) at 3 L/min so that Fe:Al becomes 20:1 in weight ratio to the plasma in the chamber. Simultaneously, acetylene gas as a carbon coating material was introduced together with the carrier gas into the chamber, thereby obtaining FeAl alloy particles as nanoparticles coated with carbon. The carbon coated FeAl nanoparticles were subjected to reduction treatment at 650° C. under hydrogen flow of 500 mL/min, and cooled to room temperature. After that, the particles were taken in an argon atmosphere containing 0.1 volume % of oxygen, and oxidized. In such a manner, the core-shell magnetic particles were manufactured.

The obtained core-shell magnetic particle has a structure that the average particle diameter of the magnetic metal particles of the core is 32 nm, and thickness of the oxide coating layer is 4 nm. The magnetic metal particle in the core was constructed by Fe—Al—C, and the composition ratio was Fe:Al:C=81:3:7 in atomic ratio. The oxide coating layer was constructed by Fe—Al—O. Such core-shell magnetic particles and a polyvinyl butyral resin were mixed at weight ratio of 100:30, and the film was thickened, thereby obtaining a magnetic material.

In evaluation of the magnetic permeability and permittivity of the obtained magnetic material, the magnetic permeability real part of the magnetic material was 2.2 (magnetic permeability imaginary part was 0.022 or less) and the permittivity real part was 3 (permittivity imaginary part was 0.03 or less) at 1 GHz.

Experimental Example 2

Argon as plasma generation gas was introduced at 40 L/min into a chamber in a high-frequency induction thermal plasma apparatus to generate plasma. Fe powders having an average particle diameter of 10 μm and Co particles having an average particle diameter of 10 μm as the material were injected together with argon (carrier gas) at 3 L/min so that Fe:Co:Al becomes 70:30:10 in atomic ratio to the plasma in the chamber. Simultaneously, acetylene gas as a carbon coating material was introduced together with the carrier gas into the chamber, thereby obtaining FeCoAl alloy particles as nanoparticles coated with carbon. The carbon coated FeCoAl nanoparticles were subjected to reduction treatment at 600° C. under hydrogen flow of 500 mL/min, and cooled to room temperature. After that, the particles were taken in an oxygen containing atmosphere, and oxidized. In such a manner, the core-shell magnetic particles were manufactured.

The obtained core-shell magnetic particle has a structure that the average particle diameter of the magnetic metal particles of the core is 18 nm, and thickness of the oxide coating layer is 2.5 nm. The magnetic metal particle in the core was constructed by Fe—Co—Al—C, and the composition ratio was Fe:Co:Al:C=70:30:0.02:0.02 in atomic ratio. The oxide coating layer was constructed by Fe—Co—Al—O. Such core-shell magnetic particles and a polyvinyl butyral resin were mixed at weight ratio of 100:30, and the film was thickened, thereby obtaining a magnetic material.

In evaluation of the magnetic permeability and permittivity of the obtained magnetic material, the magnetic permeability real part was 3 (magnetic permeability imaginary part was 0.03 or less) and the permittivity real part was 2.5 (permittivity imaginary part was 0.025 or less) at 1 GHz.

COMPARATIVE EXPERIMENTAL EXAMPLE 1

Core-shell magnetic particles were manufactured by a method similar to the first embodiment that Fe powders having an average particle diameter of 10 μm and Al powders having an average particle diameter of 3 μm as the material were injected together with argon (carrier gas) at 3 L/min so that Fe:Al becomes 20:1 in weight ratio to plasma in a chamber in a high-frequency induction heat plasma apparatus except that acetylene gas for carbonizing process is not introduced.

The obtained core-shell magnetic particle has a structure that the average particle diameter of the magnetic metal particles of the core is 40 nm, and thickness of the oxide coating layer is 5 nm. The magnetic metal particle in the core was constructed by Fe—Al, and the oxide coating layer was constructed by Fe—O. In the magnetic metal particles of the core, Al segregated and the composition varied. Such core-shell magnetic particles and a polyvinyl butyral resin were mixed at weight ratio of 100:30, and the film was thickened, thereby obtaining a magnetic material.

In evaluation of the magnetic permeability and permittivity of the obtained magnetic material, the magnetic permeability dropped from hundreds MHz to about 1 at 1 GHz, which is substantially that of air. The low magnetic characteristic was caused because the oxide coating layer was insufficient to give insulating property of the material in the core-shell particles of the comparative example 1. In the core-shell particle having the insufficient oxide coating layer, magnetic metal particles were electrically connected to each other, and an eddy-current loss occurred at high frequencies. As a result, the magnetic permeability dropped in the 1 GHz band, and it is considered that the material was not seen as a magnetic material. The electrical resistance of the magnetic material was low, and an accurate dielectric characteristic could not be evaluated.

It was understood from the above that the magnetic materials of the first and second experiments have the magnetic characteristic and the dielectric characteristic more excellent than those of the magnetic material of the comparative experimental example 1.

Second Embodiment

An antenna device of a second embodiment is similar to that of the first embodiment except that power is fed to the antenna by using the coaxial line. The same description as that of the first embodiment will not be repeated.

Figure 6:
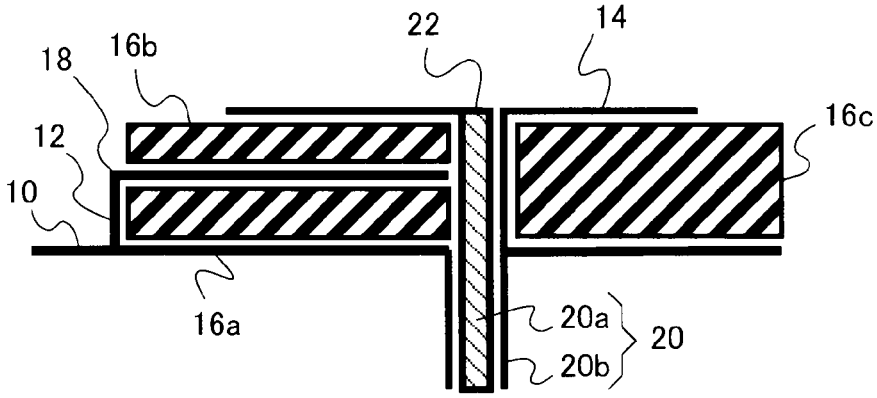
FIG. 6 is a cross-sectional view showing the configuration of a second embodiment.

FIG. 6 is a cross-sectional view showing the configuration of the antenna device of the embodiment. The antenna device has a finite ground plane 10, a rectangular conductor plate 12 provided above the finite ground plane 10, an antenna 14 disposed in substantially parallel with the finite ground plane 10 above the finite ground plane 10, and a magnetic material 16 provided in at least a part of space between the finite ground plane 10 and the antenna 14.

The finite ground plane 10 and the rectangular conductor plate 12 are made of a conductive material. One side of the rectangular conductor plate 12 is connected to the finite ground plane 10 and is electrically short-circuited. The rectangular conductor plate 12 has a bent portion 18 substantially parallel with the one side. The antenna 14 is provided above the rectangular conductor plate 12, and extends in a direction substantially perpendicular to the one side of the rectangular conductor plate 12 connected to the finite ground plane 10. A feeding point 22 of the antenna 14 is positioned near the other side opposite to the one side of the rectangular conductor plate 12. In FIG. 6, the antenna 14 is a dipole antenna.

Further, the antenna device has a coaxial line 20. The coaxial line 20 is constructed by an inner conductor 20*a* as a linear conductor and an outer conductor 20*b* as a conductor surrounding the side face of the inner conductor 20*a* in a cylindrical shape. The inner conductor 20*a* is connected to a feeding point 22, and the outer conductor 20*b* of the coaxial line 20 is short-circuited to the finite ground plane 10 just below the feeding point 22.

In the embodiment, although the antenna device has a low profile, impedance matching is realized and the broadband property can be obtained. In addition, leak current to the coaxial line 20 as a power feeder can be suppressed for a reason that the rectangular conductor plate 10 plays the role of a balance-unbalance converter called a balun. Therefore, suppression of the leak current to the coaxial line 20 can be performed simultaneously with the antenna matching and the broadband property.

Third Embodiment

An antenna device of a third embodiment is similar to that of the first embodiment except that a rectangular conductor plate and an antenna are disposed substantially in the same plane, and the rectangular conductor plate has a notch for disposing an antenna. The same description as that of the first embodiment will not be repeated.

Figure 7:
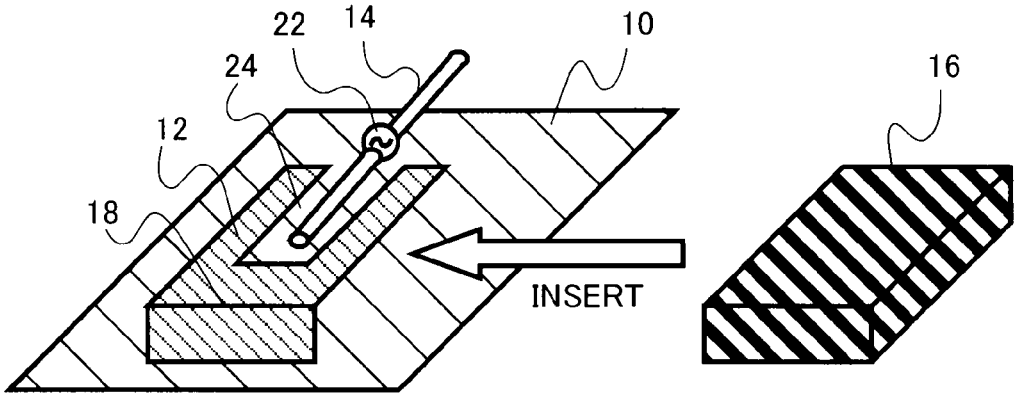
FIG. 7 is a perspective view showing the configuration of an antenna device of a third embodiment.

FIG. 7 is a perspective view showing the configuration of the antenna device of the embodiment. As shown in the diagram, an antenna 14 is disposed in substantially the same plane as a part parallel to a finite ground plane 10, of a rectangular conductor plate 12. The rectangular conductor plate 12 has a notch 24 to avoid short-circuit to the antenna 14 so that the antenna 14 can be disposed in the same plane as the part parallel with the finite ground plane 10 of the rectangular conductor plate 12.

With the configuration, in a manner similar to the first embodiment, antenna matching in a low profile and the broadband property can be obtained and, at the same time, the rectangular conductor plate 12 and the antenna 14 can be formed in the same plane. Therefore, lower profile and easier mounting can be realized.

Fourth Embodiment

An antenna device of a fourth embodiment has a finite ground plane, a magnetic material above the finite ground plane, a rectangular conductor plate above the magnetic material, a conductor passing through the magnetic material and connecting a part around one side of the rectangular conductor plate to the finite ground plane, and an antenna disposed substantially parallel with the finite ground plane above the finite ground plane, extending in a direction substantially perpendicular to the one side, and having a feeding point positioned near the other side facing the one side of the rectangular conductor plate. The expression "above" shows the positional relation with another component using, as a reference, the case where the finite ground plane is positioned below, and is not limited to an expression "above" in the vertical direction. The above is a concept including the case where two elements are in contact with each other. The fourth embodiment is similar to that of the first embodiment except that a rectangular conductor plate as a flat plate and a through hole are used in place of the rectangular conductor plate having a bent portion. The same description as that of the first embodiment will not be repeated.

Figure 8:
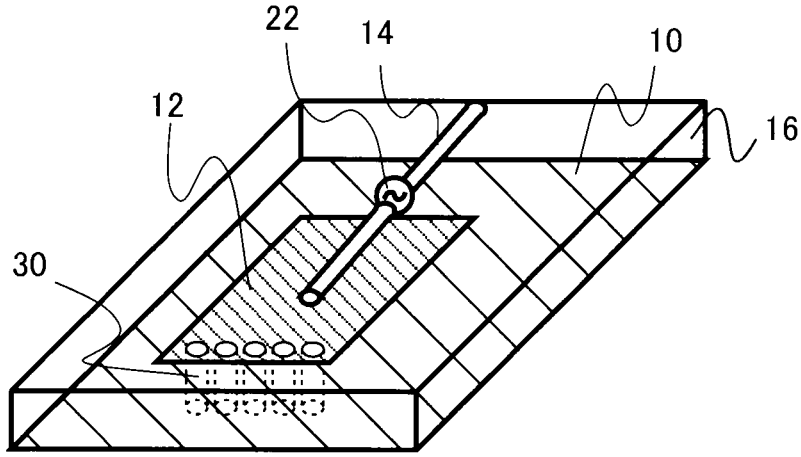
FIG. 8 is a perspective view showing the configuration of an antenna device of a fourth embodiment.

FIG. 8 is a perspective view showing the configuration of the antenna device of the embodiment. The antenna device has a finite ground plane 10, a magnetic material 16 above the finite ground plane 10, and a rectangular conductor plate 12 as a flat plate above the magnetic material 16. The antenna device also has a plurality of conductors passing through the magnetic material and for physically and electrically connecting a portion around one side of the rectangular conductor plate 12 to the finite ground plane 10. The conductors are through holes 30 obtained by opening holes in the rectangular conductor plate 12 and the magnetic material 16 and obtaining electric conduction by plating. Further, the antenna device has an antenna 14 disposed in substantially parallel with the finite ground plane 10 above the finite ground plane 10 and extending in a direction substantially perpendicular to one side of the rectangular conductor plate 12 in which the through holes 30 are provided. A feeding point 22 of the antenna device is positioned in the other side opposite to the one side of the rectangular conductor plate 12, that is, near a side farthest from the side on which the rectangular conductor plate 12 is short-circuited to the finite ground plane 10 through the through holes 30.

The expression that the through holes 30 are positioned near one side of the rectangular conductor plate 12 denotes that the distance from the one side to the through holes 30 is shorter than the distance from the other side opposite to at least one side to the through holes 30.

The structure including the rectangular conductor plate 12 and the through holes 30 in the antenna device of FIG. 8 is electrically the same as the rectangular conductor plate 12 having the bent portion in the first embodiment. The magnetic material 16 in the fourth embodiment realizes miniaturization and broader band of the antenna device by shortening of wavelengths and also functions as a mechanical structure support material. The magnetic material 16 may be a magnetic material itself or a stacked magnetic material made by a magnetic layer and a nonmagnetic dielectric layer. In the case of using the stacked structure, it is preferable to select a combination that refractive indices of the magnetic material layer and the non-magnetic dielectric layer become substantially the same for the reason that unnecessary electric wave reflection can be suppressed.

With the above configuration, in a manner similar to the first embodiment, the antenna device of the fourth embodiment can obtain impedance matching and a broader band characteristic even in the case where miniaturization including lower profile is achieved. By connecting the rectangular conductor plate and the finite ground plane via the through holes, there is another advantage that a configuration electrically equivalent to that of the first embodiment can be realized by using the printed circuit board processing technique which is conventionally common and is cheap.

Fifth Embodiment

In an antenna device of a fifth embodiment, in a manner similar to the fourth embodiment, a magnetic material is constructed by a first magnetic layer provided between the finite ground plane and a rectangular conductor plate, and a second magnetic layer above the rectangular conductor plate. An antenna is provided above the second magnetic layer. The antenna is formed as a strip line. Except for the above points, the fifth embodiment is basically similar to the fourth embodiment. The same description as that of the fourth embodiment will not be repeated.

Figure 9:
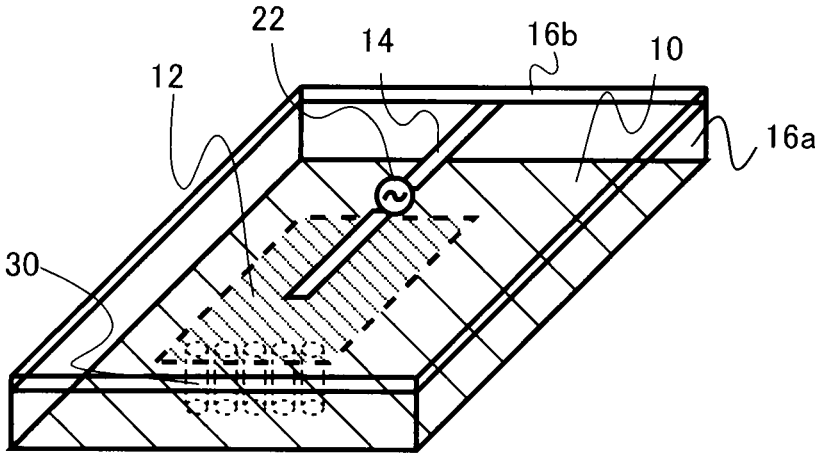
FIG. 9 is a perspective view showing the configuration of an antenna device of a fifth embodiment.

FIG. 9 is a perspective view showing the configuration of the antenna device of the embodiment. In the fifth embodiment, the magnetic material has a two-layer structure made of a first magnetic material layer 16*a* between the finite ground plane 10 and the rectangular conductor plate 12, and a second magnetic material layer 16*b* between the rectangular conductor plate 12 and the antenna 14. Each of the first and second magnetic layers 16*a* and 16*b* may be a magnetic material itself or a stacked magnetic material made by a magnetic layer and a nonmagnetic dielectric layer. In the case of using the stacked structure, like the fourth embodiment, it is preferable to select a combination that refractive indices of the magnetic material layer and the non-magnetic dielectric layer become substantially the same for the reason that unnecessary electric wave reflection can be suppressed.

The antenna 14 is formed as a strip line on the second magnetic layer 16*b*. The rectangular conductor plate 12 provided between the first and second magnetic layers 16*a* and 16*b* can be formed by a common multilayer substrate processing technique.

With the configuration, in the antenna device of the fifth embodiment, in a manner similar to the fourth embodiment, even in the case of realizing miniaturization including a lower profile, impedance matching can be obtained and the broad band characteristic can be obtained. Further, by forming the antenna 14 as a strip line on the second magnetic material layer 16*b*, the antenna device can be manufactured easily and cheaply.

The case of forming the antenna as a strip line in the structure of the magnetic material having the two-layer structure has been described. When a magnetic material of one layer is achieved by forming a notch in the rectangular conductor plate 12 and providing the antenna 14 as the strip line on the first magnetic material layer 16*a* like the third embodiment, the antenna device of one layer can be further miniaturized.

Sixth Embodiment

An antenna device of a sixth embodiment has: a finite ground plane; a comb-shaped line conductor provided above the finite ground plane, whose one end is connected on a predetermined linear line of the finite ground plane, having a bent portion which is bent at substantially right angle and is substantially parallel to the linear line, and whose other end is substantially parallel to the linear line; an antenna disposed substantially parallel with the finite ground plane above the finite ground plane, extending in a direction substantially perpendicular to the linear line, and having a feeding point positioned near the other end of the comb-shaped line conductor; and a magnetic material provided in at least a part of space between the finite ground plane and the antenna.

The antenna device of the sixth embodiment is similar to that of the first embodiment except that the comb-shaped line conductor having the bent portion is used in place of the rectangular conductor plate having the bent portion in the first embodiment. The same description as that of the first embodiment will not be repeated.

Figure 10:
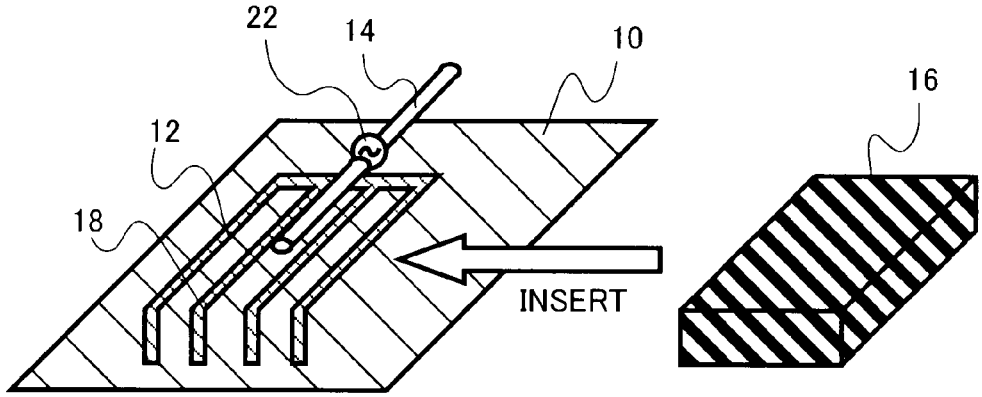
FIG. 10 is a perspective view showing the configuration of an antenna device of a sixth embodiment.

FIG. 10 is a perspective view showing the configuration of the antenna device of the sixth embodiment. As shown in the diagram, the antenna device of the embodiment has a finite ground plane 10, a comb-shaped line conductor 12 provided above the finite ground plane 10, and an antenna 14. The antenna device also has a magnetic material 16 provided at least in a part of space between the finite ground plane 10 and the antenna 14.

The comb-shaped line conductor 12 is a line conductor having a shape obtained by connecting one ends of a plurality of line conductors, or a shape having a so-called comb for combing hair. The one ends of the comb are physically and electrically connected to the finite ground plane 10 on a predetermined linear line of the finite ground plane 10. The comb-shaped line conductor 12 has a bent portion 18 which is bent at substantially right angle and is substantially parallel with the linear line. Further, the other end, that is, the end which is not connected to the finite ground plane 10 and obtained by connecting the plurality of line conductors, of the comb-shaped line conductor 12 has a shape substantially parallel with the linear line and the bent portion 18. The antenna 14 extends in a direction substantially perpendicular to the linear line and the feeding point 22 is positioned near the other end of the comb-shaped line conductor 12.

With the configuration, in a manner similar to the first embodiment, the antenna device can obtain antenna matching and a broader band characteristic in a lower profile. Further, the frequency at which antenna matching is achieved can be lowered for the following reason. In the structure of the embodiment, gaps between the parallel line conductors of the comb allow slight leak of the electric field of electromagnetic waves propagating between the comb-shaped line conductor 12 and the finite ground plane 10. However, the length in the longitudinal direction of the gap is shorter than the half wavelength of the electromagnetic wave, so that the electromagnetic wave is not emitted. Therefore, even when the length of the conductors are the same, propagation wavelength of the electromagnetic wave below the comb-shaped line conductor 12 can be made longer than that of the electromagnetic wave under the rectangular conductor plate in the first embodiment.

Seventh Embodiment

An antenna device of a seventh embodiment is similar to that of the sixth embodiment except that the comb-shaped line conductor has, while sandwiching the bent portion, a line portion substantially perpendicular to the limited bottom plate, and a line portion substantially parallel with the finite ground plane, and the substantially parallel line portion is meandering. Therefore, the same description as that of the sixth embodiment will not be repeated.

Figure 11:
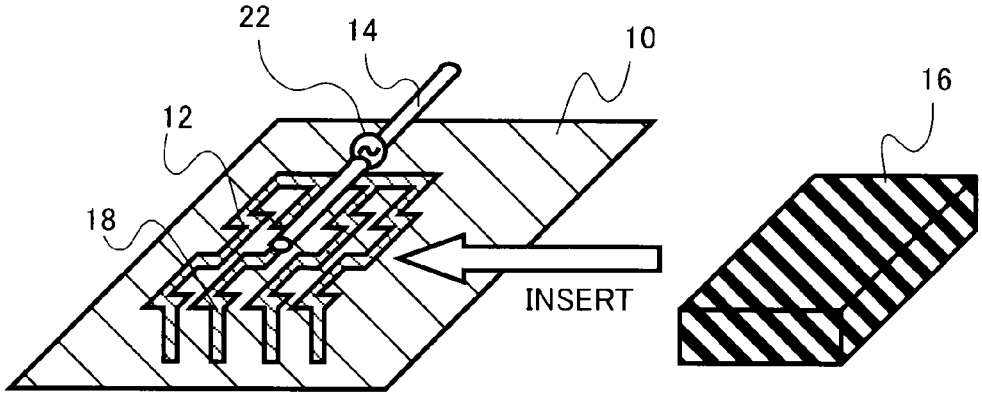
FIG. 11 is a perspective view showing the configuration of an antenna device of a seventh embodiment.

FIG. 11 is a perspective view showing the configuration of the antenna device of the embodiment. As shown in the diagram, like the antenna device of FIG. 10, the antenna device of the seventh embodiment has the comb-shaped line conductor 12. The comb-shaped line conductor 12 has, while sandwiching the bent portion 18, a line portion substantially perpendicular to the finite ground plane 10 on the side connected to the finite ground plane 10 and a line portion substantially parallel with the finite ground plane 10. The line portion substantially parallel with the finite ground plane 10 is meandering.

With the configuration, in a manner similar to the seventh embodiment, the antenna device can obtain antenna matching and a broader band characteristic in a lower profile. Further, the frequency at which antenna matching is achieved can be further lowered for the following reason. In the structure of the embodiment, electromagnetic waves propagation under the meandering comb-shaped line conductor 12 is influenced by current flowing in the meandering comb-shaped line conductor 12, and an effect of lower frequency by the current occurs.

The comb-shaped line conductor 12 and the antenna 14 may be disposed in an substantially same plane, and a notch for disposing the antenna 14 may be formed in the comb-shaped line conductor 12, thereby realizing further miniaturization.

Eighth Embodiment

An antenna device of an eighth embodiment is similar to that of the first embodiment except that a plurality of notches are provided for a side perpendicular to the one side connected to the finite ground plane, of the rectangular conductor plate. Therefore, the same description as that of the first embodiment will not be repeated.

Figure 12:
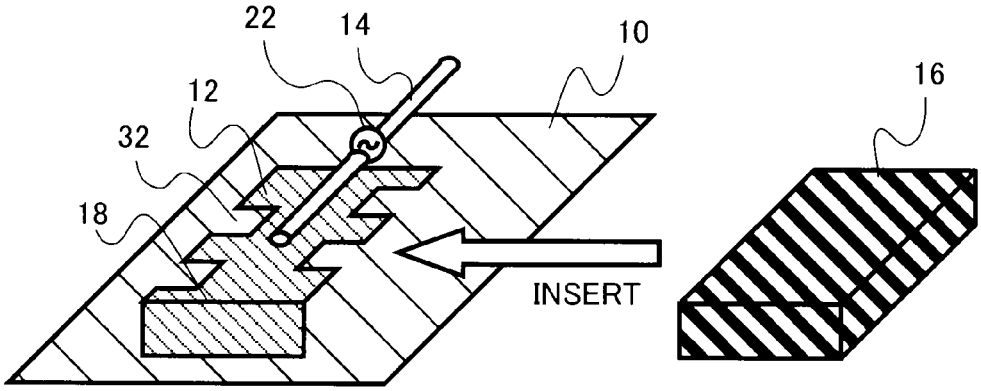
FIG. 12 is a perspective view showing the configuration of an antenna device of an eighth embodiment.

FIG. 12 is a perspective view showing the configuration of the antenna device of the eighth embodiment. Different from the antenna device of FIG. 1, a plurality of notches 32 are provided for a side perpendicular to the one side connected to the limited bottom plate 10, of the rectangular conductor plate 12.

With the configuration, in a manner similar to the first embodiment, the antenna device can obtain antenna matching and a broader band characteristic in a lower profile. Further, the frequency at which antenna matching is achieved can be further lowered for the following reason. In the structure of the embodiment, electromagnetic waves propagation under the notched rectangular conductor plate 12 is influenced by current flowing above the notched rectangular conductor plate 12, and an effect of lower frequency by the current occurs.

The embodiments of the present invention have been described above with reference to concrete examples. The embodiments are described as examples and do not limit the present invention. In the description of the embodiments, parts which are not directly necessary for the description of the present invention in the antenna device and the like are not described. However, necessary elements related to the antenna device or the like may be properly selected and used.

All of antenna devices having the elements of the present invention whose design can be properly changed by a person skilled in the art are included in the scope of the present invention. The scope of the present invention is defined by the scope of claims and the scope of equivalents of the claims.

What is claimed is:

1. An antenna device comprising:

a finite ground plane;

a rectangular conductor plate provided above the finite ground plane, whose one side is connected to the finite ground plane, and having a bent portion substantially parallel with the one side;

an antenna disposed substantially parallel with the finite ground plane above the finite ground plane, extending in a direction substantially perpendicular to the one side, and having a feeding point positioned near the other side facing the one side of the rectangular conductor plate; and a magnetic material provided in at least a part of space between the finite ground plane and the antenna, wherein the magnetic material comprises, core-shell magnetic particles including a metal core containing a magnetic metal containing at least one element selected from the group of Fe, Co, and Ni, at least one nonmagnetic metal selected from the group of Mg, Al, Si, Ca, Zr, Ti, Hf, Zn, Mn, a rare-earth element, Ba, and Sr, and at least one element selected from carbon (C) and nitrogen (N) which is dissolved into the magnetic metal, and an oxide coating layer coated on the surface of the metal core and made of an oxide containing at least one nonmagnetic metal as one of the components of the metal core, the oxide containing at least one element selected from the group of Fe, Co, and Ni which is contained in the metal core; and an insulating material of a resin or an inorganic material having gaps and in which the core-shell magnetic particles are dispersed.

2. An antenna device comprising:

a finite ground plane;

a magnetic material above the finite ground plane;

a rectangular conductor plate above the magnetic material;

a conductor passing through the magnetic material and connecting a part around one side of the rectangular conductor plate to the finite ground plane; and an antenna disposed substantially parallel with the finite ground plane above the finite ground plane, extending in a direction substantially perpendicular to the one side, and having a feeding point positioned near the other side facing the one side of the rectangular conductor plate, wherein the magnetic material comprises, core-shell magnetic particles including a metal core containing a magnetic metal containing at least one element selected from the group of Fe, Co, and Ni, at least one nonmagnetic metal selected from the group of Mg, Al, Si, Ca, Zr, Ti, Hf, Zn, Mn, a rare-earth element, Ba, and Sr, and at least one element selected from carbon (C) and nitrogen (N) which is dissolved into the magnetic metal, and an oxide coating layer coated on the surface of the metal core and made of an oxide containing at least one nonmagnetic metal as one of the components of the metal core, the oxide containing at least one element selected from the group of Fe, Co, and Ni which is contained in the metal core; and an insulating material of a resin or an inorganic material having gaps and in which the core-shell magnetic particles are dispersed.

3. The antenna device according to claim 1, further comprising a coaxial line, wherein the coaxial line is connected to the feeding point, and an outer conductor of the coaxial line is connected to the finite ground plane below the feeding point.

4. The antenna device according to claim 1, wherein the rectangular conductor plate and the antenna are disposed in an substantially same plane, and a notch for disposing the antenna is formed in the rectangular conductor plate.

5. The antenna device according to claim 2, wherein the magnetic material includes a first magnetic layer provided between the finite ground plane and the rectangular conductor plate, and a second magnetic layer above the rectangular conductor plate, and the antenna is provided above the second magnetic layer.

6. The antenna device according to claim 1, wherein a plurality of notches are formed in a side perpendicular to the one side of the rectangular conductor plate.

7. The antenna device according to claim 1, further comprising a dielectric material occupying a space other than a space occupied by the magnetic material provided between the finite ground plane and the antenna, and refractive indices of the dielectric and the magnetic material are substantially the same.

8. The antenna device according to claim 1, wherein the metal core contains 0.001 atomic % to 20 atomic % of the nonmagnetic metal and 0.001 atomic % to 20 atomic % of the element.

9. The antenna device according to claim 1, wherein the metal core contains FeCo, Al, and carbon, the oxide coating layer contains Al, wherein the FeCo in the metal core contains 10 atomic % to 50 atomic % of Co into the FeCo, and 0.001 atomic % to 5 atomic % of Al with respect to the FeCo and 0.001 atomic % to 5 atomic % of carbon with respect to the FeCo are contained in the metal core.

10. The antenna device according to claim 1, wherein filling ratio in the magnetic material of the core-shell magnetic particles is in a range of 10 vol % to 70 vol %, and filling ratio in the magnetic material of the insulting material is in a range of 5 vol % to 80 vol %.

11. The antenna device according to claim 1, wherein the magnetic material is a stack-type magnetic material formed by a magnetic layer and a nonmagnetic dielectric layer.

12. The antenna device according to claim 1, wherein magnetic permeability of the magnetic material is in the range of 1 to 10 and permittivity of the magnetic material is in the range of 1 to 10.

13. The antenna device according to claim 12, wherein the magnetic permeability of the magnetic material is in the range of 1 to 5, and the magnetic permeability is higher than the permittivity.

14. The antenna device according to claim 12, wherein the magnetic permeability of the magnetic material is in the range of 1 to 5, and the permittivity is higher than the magnetic permeability.

15. The antenna device according to claim 1, wherein the oxide contains all elements selected from the group of Fe, Co, and Ni which are contained in the metal core.

16. The antenna device according to claim 2, wherein the oxide contains all elements selected from the group of Fe, Co, and Ni which are contained in the metal core.

17. The antenna device according to claim 1, wherein the magnetic metal contains Fe and the oxide contains Fe.

18. The antenna device according to claim 2, wherein the magnetic metal contains Fe and the oxide contains Fe.

19. The antenna device according to claim 1, wherein the oxide contains substantially no carbon.

20. The antenna device according to claim 2, wherein the oxide contains substantially no carbon.

* * * * *